US005180449A

United States Patent [19]

Masui et al.

[11] Patent Number: 5,180,449

[45] Date of Patent: Jan. 19, 1993

[54] GALVANIZED HIGH-STRENGTH STEEL SHEET HAVING LOW YIELD RATIO AND METHOD OF PRODUCING THE SAME

[75] Inventors: Susumu Masui; Kei Sakata; Fusao Togashi, all of Chiba, Japan

[73] Assignee: Kawasaki Steel Corp., Hyogo, Japan

[21] Appl. No.: 822,163

[22] Filed: Jan. 16, 1992

[30] Foreign Application Priority Data

Jan. 21, 1991 [JP] Japan ..... 3-44580

[51] Int. Cl.[5] ..... C23C 2/00; C23C 2/06

[52] U.S. Cl. ..... 148/533; 148/331; 148/333; 428/659

[58] Field of Search ..... 148/12 D, 156, 12 F, 148/333, 331, 533; 428/659

[56] References Cited

U.S. PATENT DOCUMENTS 4,525,598 6/1985 Tsukamoto et al. ..... 428/659
4,960,158 10/1990 Yamada et al. ..... 148/156

FOREIGN PATENT DOCUMENTS 875960 8/1979 Belgium .
1200473 2/1986 Canada .
01-22821 9/1980 Japan ..... 148/12 D
62-20821 1/1987 Japan .

*Primary Examiner*—R. Dean
*Assistant Examiner*—Sikyin Ip
*Attorney, Agent, or Firm*—Bierman and Muserlian

[57] ABSTRACT

A galvanized steel sheet is provided which has a tensile strength of not less than 80 kgf/mm$^2$ and a yield ratio of not more than 60%, and which is applicable to members of an automobile body, particularly those requiring strength.

By appropriately controlling the amounts of components, such as C, Mn, Nb, Ti and B, the structure of the steel sheet is formed into a dual-phase structure having a second phase strucutre. The steel sheet is recrystallization-annealed, galvanized while it is maintained at a temperature range near 500° C., and then is cooled. By controlling the rate of cooling the steel sheet, the second phase structure generated is prevented from hardening more than necessary. A galvanized high-strength steel sheet is obtained which has a low yield ratio and excellent stretch-flanging properties.

4 Claims, 2 Drawing Sheets

GALVANIZED HIGH-STRENGTH STEEL SHEET HAVING LOW YIELD RATIO AND METHOD OF PRODUCING THE SAME

BACKGROUND OF THE INVENTION

Field of the Invention

The present invention relates to a galvanized steel sheet having a tensile strength (hereinafter denoted as a T.S.) of not less than 80 kgf/mm$^2$ and a yield ratio (hereinafter denoted as a Y.R.) of not more than 60%, which sheet is preferably used for members of an automobile, such as bumpers or bars for protecting the doors, which require high strength.

To reduce the weight primarily of automobiles, high-strength steel sheets are widely used as outer and structural materials for automobile bodies. Such steel sheets are required to have strength sufficient for meeting the demand of automobile safety, in addition to having excellent press workability.

In recent years, there has been an increasing demand for further reducing the weight of automobiles, as well as for protecting automobiles from rust. There has been a trend toward employing galvanized steel sheets for automobile members, including bumpers and bars for protecting automobile doors, whose weights have hitherto not been reduced.

As regards a type of galvanized steel sheet, having a T.S. of 80 kgf/mm$^2$ or more, which is used for the members mentioned above, a galvanized steel sheet having a T.S. ranging from 100 to 120 kgf/mm$^2$ is disclosed in Japanese Patent Laid-Open No. 1-198459. This sheet has yield strength ranging from 68.1 to 99.2 kgf/mm$^2$, as high as 65% to 81% in terms of Y.R., thus resulting in a problem concerning form retention after having been worked.

As regards a type of cold-rolled steel sheet, a dual-phase type steel sheet of strength ranging from 100 to 120 kgf/mm$^2$ is in use. Japanese Patent Publication No. 57-61819 discloses such a steel sheet employed as a plated steel sheet. This publication also discloses the fact that, when the dual-phase steel sheet is galvanized on a continuous galvanizing line having a low-temperature zone, the steel sheet transforms from $\gamma$ to $\alpha$ or from $\gamma$ to bainite. The amount of martensite is insufficient for obtaining strength ranging from 100 to 120 kgf/mm$^2$.

SUMMARY OF THE INVENTION

An object of the present invention is to provide a galvanized steel sheet having a dual-phase structure, a high tensile strength and a low yield ratio, which steel sheet has heretofore been difficult to produce. Another object of this invention is to provide a method of producing such a steel sheet, in which a continuous galvanizing line in particular is applicable.

Because of recent developments in pretreatment of materials difficult to plate, various limitations on the amounts and types of alloy components to be added have been decreased, thus increasing the range from which alloy components can be selected. The inventors of this invention reexamined the component composition and its range of the above materials, found a clue to solving the problem mentioned above, and then achieved this invention.

In accordance with one aspect of the present invention, there is provided a galvanized high-strength steel sheet having a low yield ratio wherein a galvanized layer is applied to a surface of a steel sheet having a composition containing 0.08 to 0.20 wt% (hereinafter denoted by only %) of C, 1.5 to 3.5 % of Mn, 0.010 to 0.1 % of Al, 0.010% or less of P, 0.001% or less of S, one or both of 0.010 to 0.1% of Ti and 0.010 to 0.1% of Nb, and the balance substantially Fe and incidental impurities. This galvanized high-strength steel sheet further contains one or both of 0.1 to 0.5% of Cr and 0.0005 to 0.003% of B.

In accordance with another aspect of this invention, there is provided a method of producing a galvanized high-strength steel sheet having a low yield ratio, the method comprising the steps of: preparing a steel slab having a composition containing 0.08 to 0.20% of C, 1.5 to 3.5% of Mn, 0.010 to 0.1% of Al, 0.010% or less of P, 0.001% or less of S, one or both of 0.010 to 0.1% of Ti and 0.010 to 0.1% of Nb, and the balance substantially Fe and incidental impurities; hot-rolling the steel slab; cold-rolling the steel slab; forming the steel slab into a steel strip having a final thickness; heating the steel strip in a temperature range of ($Ar_3-30°$ C.) to ($Ar_3+70°$ C.) or less; recrystallization-annealing the steel strip; cooling the steel strip at a cooling rate of not less than 5° C./s in a temperature range of 450° C. to 550° C.; galvanizing the steel strip while maintaining it in the temperature range for 1 minute to 5 minutes; and cooling the steel strip at a cooling rate of 2° C./s to 50° C./s. The steel slab further contains one or both of 0.1 to 0.5% of Cr and 0.0005 to 0.003% of B.

DESCRIPTION OF THE PREFERRED EMBODIMENT

Figure 1:
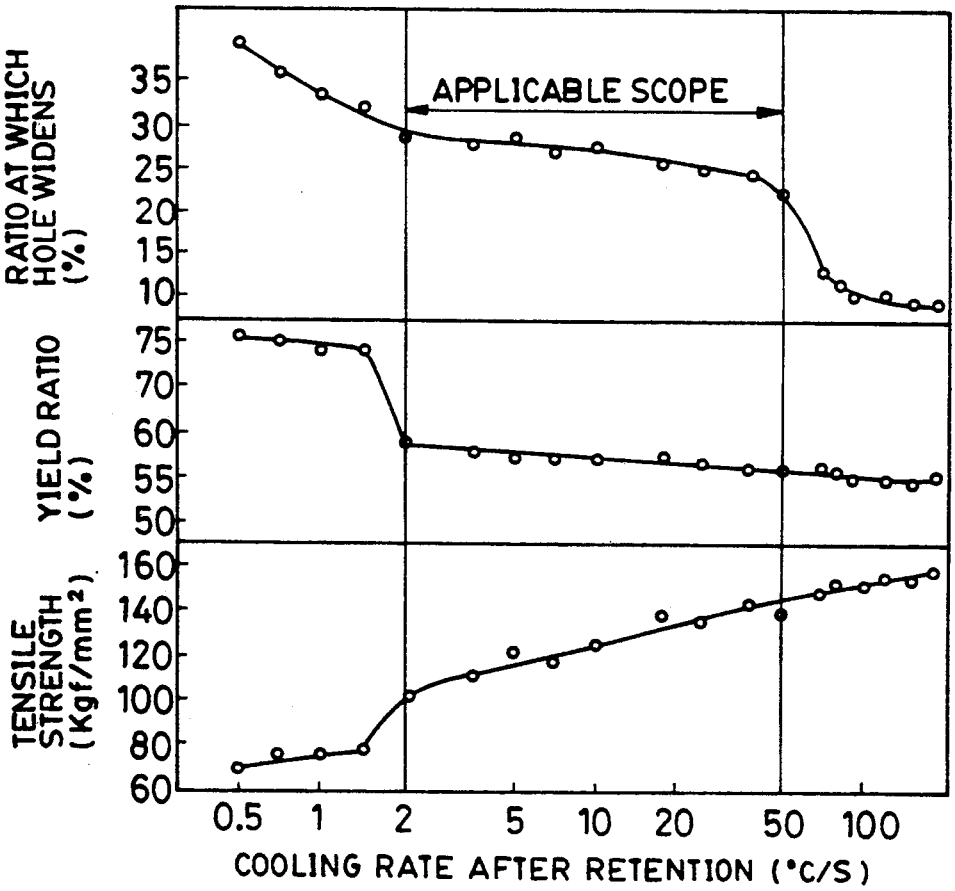
FIG. 1 is a graph showing the relationship between T.S., Y.R., $\lambda$ and the cooling rate, on a continuous galvanizing line, after a steel sheet of this invention has been maintained at a temperature range from 450° C. to 550° C.
Figure 2A:
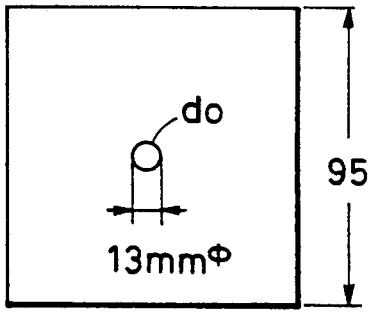
FIG. 2 is a schematic view showing a method of performing an experiment for widening a hole.
Figure 2B:
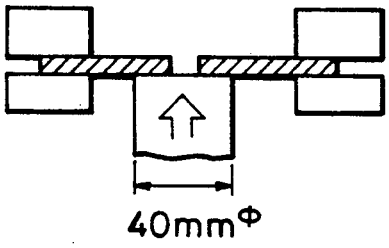
Figure 2C:
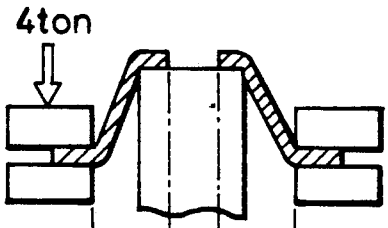
Figure 2D:
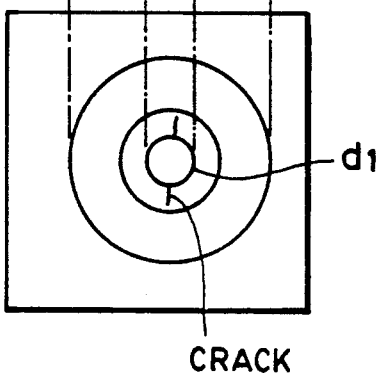

After numerous experiments and investigations, the inventors have made the following findings:

Ni and Ti, both forming carbides that can be stably present in even an austenitic region, should be contained in appropriate amounts. The suitable range of annealing temperature is thereby widened, resulting in fewer production limitations.

Mn, Cr and B, all components stabilizing austenite, should be contained in appropriate amounts. Because the steel sheet is thereby maintained at a temperature range near 500° C. for several minutes, so-called phase separation proceeds, even if a component, such as Si, which promotes a ferritic transformation, is not added. A typical dual-phase structure is obtained.

The cooling rate is controlled after the steel sheet has been maintained in the above temperature zone. It is thereby possible to prevent a generated second phase structure from hardening more than required. Stretch-flanging properties are improved.

Reasons are given for limiting the range under which the chemical components of a steel sheet according to this invention fall.

C: 0.08 to 0.20%

When C content is less than 0.08%, a dual-phase structure required for securing a desired T.S. during galvanizing cannot be obtained. Therefore, the lower limit should be 0.08%. When C content exceeds 0.20%, it is difficult to perform spot welding on steel sheets for automobiles, to which this invention is applied, thus decreasing welding strength. Therefore, the upper limit should be 0.20%.

Mn: 1.5 to 3.5%

Mn is a component tending to concentrate in an austenitic phase in the region where ferritic and austenitic phases are present. Because of such a tendency, phase separation proceeds easily by maintaining the steel sheet at a constant temperature near 500° C., even when the steel sheet is not quenched immediately after annealing. Mn content of 1.5% or more is required to promote the phase separation. However, if it is more than 3.5%, anti-powdering properties and the balance of strength and ductility are deteriorated. Thus, Mn content should be 1.5% or more and 3.5% or less.

P: 0.010% or less

P is a harmful element. When it is contained in large amounts, it deteriorates spot weldability and bending workability in a certain direction, particularly that perpendicular to the direction of rolling. This deterioration in the bending workability is caused by ferrite banding ascribable to central segregation of P. A large amount of P causes an adverse effect, such as the development of uneven baking finish after plating has been performed. Therefore, P content should be limited to 0.01% or less.

S: 0.001% or less

S, like P, is a harmful component. When S is contained in large amounts, it deteriorates spot weldability and stretch-flanging properties. S content should therefore be limited to 0.001% or less.

Al: 0.01 to 0.1%

Al is a component required as a deoxidiser. When Al content is less than 0.01%, the effect of the deoxidiser cannot be expected, whereas when it is more than 0.10%, deoxidation is not effective. Al content ranges from 0.01 to 0.1%, and is not effective if it is more than 0.1%.

Nb: 0.010 to 0.1%, and Ti: 0.010 to 0.1%

Nb and Ti form carbides, such as NbC and TiC, which are stable even in the austenitic region. These components have the same advantageous effects: increasing the suitable range of annealing temperature; stabilizing the structure; and making it easy to control annealing temperature. Such effects become pronounced when Nb or Ti content is 0.010% or more, and is not obtained when it is at 0.1%. For Nb or Ti content, the lower limit should be 0.010% and the upper limit should be 0.1%. Either Nb or Ti, or both may be added within the above range of components.

Cr: 0.1 to 0.5%

Cr, like Mn, is a component tending to concentrate in the austenitic phase in the region where ferritic and austenitic phases are present. Because of such a tendency, phase separation proceeds easily by maintaining the steel sheet at a constant temperature near 500° C., even when the steel sheet is not quenched immediately after annealing. Cr content of 0.1% or more is required to promote phase separation. However, if it is more than 0.5%, the anti-powdering properties and the balance of strength and ductility are deteriorated. Cr content should be 0.1% to 0.5%.

B: 0.0005 to 0.003%

B is a component similar to Cr in that both components promote phase separation. That is, B in a dissolved state segregates at an austenitic boundary. Austenite is caused to be stably present at relatively low temperatures. Thus, by maintaining the steel sheet at a constant temperature near 500° C., phase separation proceeds easily, even when the steel sheet is not quenched immediately after annealing. B content of 0.0005% or more is required to promote phase separation, which is not effective when B content is at 0.003%. Therefore, the lower limit should be 0.0005%, and the upper limit, 0.003%.

Either Cr or B, or both may also be added.

Reasons will now be set forth for controlling temperature and cooling conditions under which continuous galvanizing is performed.

First, the annealing temperature should be ($Ar_3-30°$ C.) to ($Ar_3+70°$ C.). When it exceeds ($Ar_3+70°$ C.), the carbides themselves, such as NbC and TiC, become coarse, and the effect of restraining the growth of austenitic grains is remarkably lowered. An austenitic structure therefore becomes coarse, and so does a structure obtained after cooling, thus deteriorating mechanical properties. On the other hand, when the annealing temperature is less than ($Ar_3-30°$ C.), the required austenitic structure is incomplete, and the desired properties cannot be obtained. That is, when the annealing is performed at a temperature range from ($Ar_3-30°$ C.) to ($Ar_3+70°$ C.), significant differences cannot be recognized in the structure obtained after cooling, even if annealing temperature varies. Differences in mechanical properties decrease, and the product obtained exhibits satisfactory mechanical properties. This is because the carbides, such as NbC and TiC, are present in a relatively stable condition even in a wide temperature range of austenite, thus effectively restraining the growth of the austenitic grains. Furthermore, during cooling, these carbides function as nucleation sites of ferrite when austinite is transformed to ferrite, and then become microstructures advantageous to mechanical properties. Thus, the annealing temperature should be within a range of ($Ar_3-30°$ C.) to ($Ar_3+70sC$).

Next, after annealing, the steel sheet is cooled at a rate of 5° C./s or more in a temperature range from 450° C. to 550° C. When a cooling rate is less than 5° C./s, a pearlite transformation cannot be avoided; consequently, a second phase becomes pearlite, and the desired strength cannot be obtained. Thus, after annealing the cooling rate should be 5° C./s or more in a temperature range from 450° C. to 550° C.

The time for maintaining the steel sheet in a temperature range from 450° C. to 550° C. should be 1 minute to 5 minutes. Galvanizing is performed during the above maintenance time. The time for galvanizing and alloying is not limited specifically, and these operations may be performed within the above time. However, the maintenance time considerably affects the structure of the steel sheet. When the maintenance time is less than 1 minute, phase separation is incomplete. An intended dual-phase structure cannot be obtained after subsequent cooling. On the other hand, when it is more than 5 minutes, the phase separation is promoted excessively. Differences are increased in the strength between the second phase structure and ferrite in the dual-phase structure generated after the subsequent cooling, thereby deteriorating the stretch-flanging properties. Thus, the time for maintaining the steel sheet in a temperature range from 450° C. to 550° C. should be 1 minute to 5 minutes.

Next, after the steel sheet has been maintained in a temperature range from 450° C. to 550° C., it is cooled at a rate of 2° C./s to 50° C./s.

A steel slab is subjected to hot rolling, pickling, cold rolling and then is formed into a 1 mm thick cold-rolled sheet in accordance with standard methods. The composition of the steel slab includes 0.09% of C, 3.0% of Mn, 0.12% of Cr, 0.045% of Nb, 0.03% of Al, 0.01% of P, 0.001% of S, and the balance, substantially Fe and incidental impurities. The steel sheet is then annealed at 850° C., and is cooled to a temperature range from 450° C. to 550° C. This cooling is performed at a rate of 10° C./s. Thereafter, the steel sheet is maintained at this temperature range for approximately 3 minutes, and then is cooled at various cooling rates. FIG. 1 shows the relationship between T.S., Y.R., the ratio λ at which a hole is widened, which ratio indicates stretch-flanging properties, and the cooling rate after maintaining the steel sheet at the above temperature range.

The ratio λ of widening the hole is measured in the following manner. As shown in FIG. 2(*a*), a hole having a diameter 37 $d_0$" of 13 mm is punched at the center of a square piece, each side being 95 mm long. This piece is used as a test piece. Right and left sides of the piece are fixed, as shown in FIG. 2(*b*). As shown in FIG. 2(*c*), a punch with a diameter of 40 mm is pressed against the center of the test piece, and the diameter "$d_1$" of a hole formed in the test piece is measured. The ratio λ of widening the hole is calculated from the following equation:

$$\lambda = \frac{d_1 - d_0}{d_0} \times 100(\%)$$

As is apparent from FIG. 1, if the cooling rate is less than 2° C./s after maintaining the steel sheet at the above temperature, Y.R. increases abruptly. This appears to be because the second structure is tempered, thereby reducing differences in strength with respect to ferrite and abruptly increasing Y.R. On the other hand, if the cooling rate exceeds 50° C./s, the ratio λ of widening the hole decreases sharply. This is because the second phase structure hardens more than necessary, thereby increasing the differences in strength with respect to ferrite. Thus, the cooling rate should be 2° C./s to 50° C./s after maintaining the steel sheet at a temperature range from 450° C. to 550° C.

As has been described above, a cooling rate, particularly that used after maintaining the steel sheet at a constant temperature, is set appropriately in a continuous galvanizing line, whereby it is possible to obtain a galvanized steel sheet having excellent stretch-flanging properties, a T.S. of not less than 80 kgf/mm² and a Y.R. of not more than 60%.

EXAMPLE

A total of 12 types of steel sheets as shown in Table 1, 8 types applicable to a range of chemical components according to this invention and 4 types compared with the 8 types, were melted in a converter. A steel slab obtained by a reheating method or a continuous direct feed rolling method was subjected in accordance with the standard method to hot rolling at a final rolling temperature ranging from 800° C. to 900° C. After the steel sheet had been wound at a temperature range from 500° C. to 700° C., it was subjected to pickling and then to cold rolling, and was formed into a cold-rolled steel sheet having a thickness of 1 mm.

Galvanizing was performed to the cold-rolled steel sheets under the conditions shown in Table 2, which also shows the results of investigation concerning the T.S., the ratio λ of widening a hole, the strength of a spot-welded joint, etc. of the galvanized steel sheets.

In Table 2, a primary cooling rate is a rate for cooling the steel sheets from the annealing temperature to a temperature range from 450° C. to 550° C. A secondary cooling rate is a rate for cooling the steel sheets from the above temperature range to room temperature. Tensile properties indicate the results of a tensile test conducted in accordance with JIS Z 2241. The ratio λ of windening a hole was measured in the same manner as described above.

Table 3 shows various properties of two types of steel "C" and "H" when the steel is plated and alloyed. After primary cooling, the two types of steel are maintained at a temperature which is out of a temperature range from 450° C. to 550° C., which range is suitable for this invention.

As obvious from Tables 2 and 3, a tensile strength, as high as 80 kgf/mm² or more, and a yield ratio, as low as 60% or less, could be obtained from all types of steel under the conditions of this invention. It was confirmed that the ratio λ of widening a hole was satisfactory, that the strength was sufficient in spot welding, and that plating did not fail. Sample 16 is a type of steel in which C content is as large as 0.26%, causing strength which is insufficient in spot welding. Sample 24 is a type of steel in which plating fails because the temperature at which the steel was maintained after the primary cooling is too low.

This invention makes it possible to produce a galvanized steel sheet having a T.S. of not less than 80 kgf/mm² and a Y.R. of not more than 60%, thus enlarging the use application of such a galvanized steel sheet.

TABLE 1

| STEEL | CHEMICAL COMPOSITION (wt %) | | | | | | | | | $Ar_3$ | |
|---|---|---|---|---|---|---|---|---|---|---|---|
| SYMBOL | C | Mn | P | S | Al | Nb | Ti | Cr | B | (°C.) | REMARKS |
| A | 0.11 | 2.95 | 0.006 | 0.0007 | 0.04 | 0.05 | | | | 833 | Invention |
| B | 0.13 | 2.60 | 0.010 | 0.0005 | 0.03 | | 0.03 | | | 831 | |
| C | 0.19 | 1.70 | 0.008 | 0.0010 | 0.02 | 0.04 | 0.06 | | | 820 | |
| D | 0.09 | 3.00 | 0.005 | 0.0008 | 0.05 | 0.07 | | 0.20 | | 849 | |
| E | 0.16 | 2.30 | 0.006 | 0.0010 | 0.03 | | 0.05 | | 0.0015 | 824 | |
| F | 0.12 | 2.80 | 0.007 | 0.0006 | 0.02 | 0.03 | 0.04 | 0.40 | | 836 | |
| G | 0.15 | 2.40 | 0.010 | 0.0005 | 0.04 | 0.02 | 0.02 | | 0.0025 | 830 | |
| H | 0.10 | 3.10 | 0.006 | 0.0010 | 0.03 | 0.04 | 0.01 | 0.35 | 0.0010 | 839 | |
| I | 0.26 | 1.90 | 0.008 | 0.0010 | 0.03 | | 0.07 | | | 795 | Comparative |
| J | 0.05 | 2.40 | 0.005 | 0.0007 | 0.04 | 0.06 | | 0.30 | 0.0005 | 864 | Example |
| K | 0.16 | 2.40 | 0.010 | 0.0008 | 0.05 | | | 0.25 | 0.0020 | 820 | |
| L | 0.13 | 2.70 | 0.050 | 0.0030 | 0.04 | 0.05 | 0.03 | 0.10 | 0.0010 | 832 | |

TABLE 2

| SAMPLE NO. | STEEL SYMBOL | ANEEAL-ING TEM. (°C.) | PRIMARY COOLING RATE (°C./s) | DWELL TIME AT TEM. 450–550° C. (s) | SECONDARY COOLING RATE (°C./s) | Y.S. kgf/mm² | T.S. kgf/mm² | Y.R. % | EI % | λ % | REMARKS |
|---|---|---|---|---|---|---|---|---|---|---|---|
| 1 | A | 820 | 10 | 120 | 25 | 53 | 95 | 56 | 20 | 33 | Invention |
| 2 | A | 850 | 15 | 80 | 10 | 56 | 99 | 57 | 19 | 30 | Invention |
| 3 | A | 750 | 20 | 160 | 15 | 62 | 110 | 56 | 13 | 4 | Comp. Ex. |
| 4 | B | 815 | 15 | 180 | 20 | 53 | 92 | 58 | 24 | 37 | Invention |
| 5 | B | 920 | 25 | 100 | 15 | 80 | 112 | 71 | 8 | 11 | Comp. Ex. |
| 6 | C | 860 | 15 | 180 | 30 | 50 | 87 | 57 | 29 | 41 | Invention |
| 7 | C | 810 | 4 | 150 | 20 | 55 | 78 | 71 | 36 | 49 | Comp. Ex. |
| 8 | D | 845 | 30 | 120 | 15 | 56 | 101 | 55 | 17 | 29 | Invention |
| 9 | D | 860 | 15 | 360 | 25 | 56 | 113 | 50 | 21 | 10 | Comp. Ex. |
| 10 | E | 840 | 30 | 210 | 25 | 66 | 124 | 53 | 11 | 23 | Invention |
| 11 | E | 815 | 20 | 330 | 10 | 67 | 133 | 50 | 12 | 9 | Comp. Ex. |
| 12 | F | 825 | 25 | 240 | 10 | 60 | 107 | 56 | 15 | 27 | Invention |
| 13 | F | 850 | 10 | 180 | 60 | 65 | 125 | 52 | 16 | 9 | Comp. Ex. |
| 14 | G | 825 | 25 | 150 | 15 | 52 | 92 | 57 | 25 | 39 | Invention |
| 15 | G | 910 | 10 | 180 | 20 | 88 | 110 | 80 | 7 | 12 | Comp. Ex. |
| 16 | H | 830 | 20 | 120 | 20 | 55 | 101 | 54 | 17 | 28 | Invention |
| 17 | H | 795 | 15 | 90 | 35 | 63 | 120 | 53 | 14 | 4 | Comp. Ex. |
| 18 | I | 805 | 20 | 120 | 10 | 65 | 117 | 56 | 12 | 26 | Comp. Ex. |
| 19 | J | 860 | 25 | 270 | 40 | 47 | 77 | 61 | 38 | 52 | Comp. Ex. |
| 20 | K | 870 | 15 | 90 | 25 | 89 | 111 | 80 | 6 | 14 | Comp. Ex. |
| 21 | L | 835 | 10 | 150 | 15 | 62 | 108 | 57 | 15 | 20 | Comp. Ex. |
| 22 | B | 820 | 20 | 55 | 20 | 68 | 90 | 76 | 21 | 37 | Comp. Ex. |
| 23 | C | 850 | 15 | 60 | 25 | 49 | 86 | 57 | 30 | 42 | Invention |

Comp. Ex.: Comparative Example
Poor spot welding was observed in Sample No. 18.

TABLE 3

| SAMPLE NO. | STEEL SYMBOL | ANEEAL-ING TEM. (°C.) | PRIMARY COOLING RATE (°C./s) | DWELL TEM. & TIME AFTER PRIMARY COOLING: TEMPERATURE (°C.) | DWELL TEM. & TIME AFTER PRIMARY COOLING: TIME (S) | SECONDARY COOLING RATE (°C./s) | Y.S. kgf/mm² | T.S. kgf/mm² | Y.R. % | EI % | λ % | REMARKS |
|---|---|---|---|---|---|---|---|---|---|---|---|---|
| 24 | C | 835 | 20 | 420–440 | 150 | 20 | 52 | 91 | 57 | 26 | 39 | Comparative Example |
| 25 | C | 825 | 25 | 570–590 | 120 | 15 | 64 | 93 | 68 | 24 | 37 | Comparative Example |

Failure in plating and development of yield elengation were observed in Sample Nos. 24 and 25.

What is claimed is:

1. A method of producing a galvanized high-strength steel sheet having a tensile strength of not less than 80 kgf/mm² and a yield ratio of not more than 60%, the method comprising the steps of: preparing a steel slab having a composition of 0.08 to 0.20 wt % of C, 1.5 to 3.5 of wt % of Mn, 0.010 to 0.1 wt % of Al, 0.010 wt % or less of P, 0.001 wt % or less of S, one or both of 0.010 to 0.1 wt % of Ti and 0.010 to 0.1 wt % of Nb, and the balance substantially Fe and incidental impurities; hot-rolling said steel slab; cold-rolling said steel slab; forming said steel slab into a steel strip having a final thickness; heating said steel strip in a temperature range from ($Ar_3$ − 30° C.) to ($Ar_3$ − 70° C.); recrystallization-annealing said steel strip; cooling said steel strip at a cooling rate of not less than 5° C./s to a temperature range from 450° C. to 550° C.; galvanizing said steel strip while maintaining it in said temperature range for 1 minute to 5 minutes or less; and cooling said galvanized steel strip at a cooling rate of 2° C./s to 50° C./s.

2. A method of producing a galvanized high-strength steel sheet of claim 1 wherein said steel slab further contains one or both of 0.1 to 0.5 wt % of Cr and 0.0005 to 0.003 wt % of B.

3. A galvanized high-strength steel sheet produced by the process of claim 1 having a tensile strength of not less than 80 kgf/mm² and a yield ratio of not more than 60%.

4. A galvanized high-strength steel sheet of claim 3 further containing one or both of 0.1 to 0.5 wt % of Cr and 0.0005 to 0.003 wt % of B.

* * * * *